US005532440A

United States Patent [19]

Fujiwara

[11] Patent Number: 5,532,440

[45] Date of Patent: Jul. 2, 1996

[54] LIGHT TRANSMISSIVE SOUND ABSORBING MEMBER

[75] Inventor: Kyoji Fujiwara, Fukuoka, Japan

[73] Assignee: Nitto Boseki Co., Ltd., Japan

[21] Appl. No.: 351,645

[22] Filed: Dec. 7, 1994

[30] Foreign Application Priority Data

Dec. 10, 1993 [JP] Japan ..... 5-341598

[51] Int. Cl.[6] ..... E04B 9/00

[52] U.S. Cl. ..... 181/289; 181/292

[58] Field of Search ..... 181/288, 289, 181/290, 291, 292

[56] References Cited

U.S. PATENT DOCUMENTS

| | | | |
|---|---|---|---|
| 2,850,109 | 9/1958 | Benjamin | 181/289 |
| 3,174,580 | 3/1965 | Schultz et al. . | |
| 3,380,552 | 4/1968 | Segil et al. | 181/292 |
| 4,019,295 | 4/1977 | Derner et al. | 181/289 |
| 4,787,296 | 11/1988 | Huang | 181/289 X |

FOREIGN PATENT DOCUMENTS

| | | |
|---|---|---|
| 0504629 | 9/1992 | European Pat. Off. . |
| 4315759 | 5/1994 | Germany . |
| 8502640 | 6/1985 | WIPO . |

*Primary Examiner*—Khanh Dang

*Attorney, Agent, or Firm*—Sixbey, Friedman, Leedom & Ferguson; Gerald J. Ferguson, Jr.; David S. Safran

[57] ABSTRACT

In the sound absorbing member, partition members each formed of sound absorbing material are disposed between first and second light transmissive sheet members to thereby form a plurality of small spaces, and first and second through holes are formed in the first and second sheet members, respectively, in such a manner that the first through holes communicate with other small spaces than the small spaces in communication with the second through holes.

5 Claims, 11 Drawing Sheets

Measurement frequency: 160Hz – 1250Hz

Measurement frequency: 630Hz – 4KHz

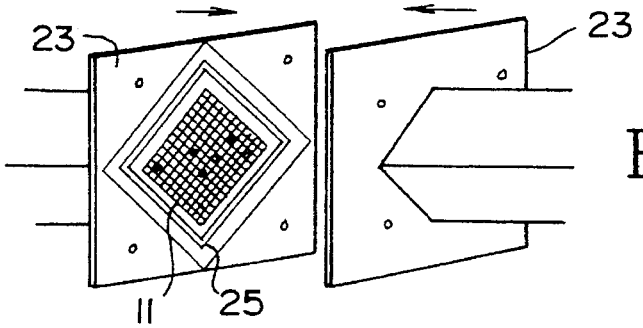
FIG. 11
FIG. 12
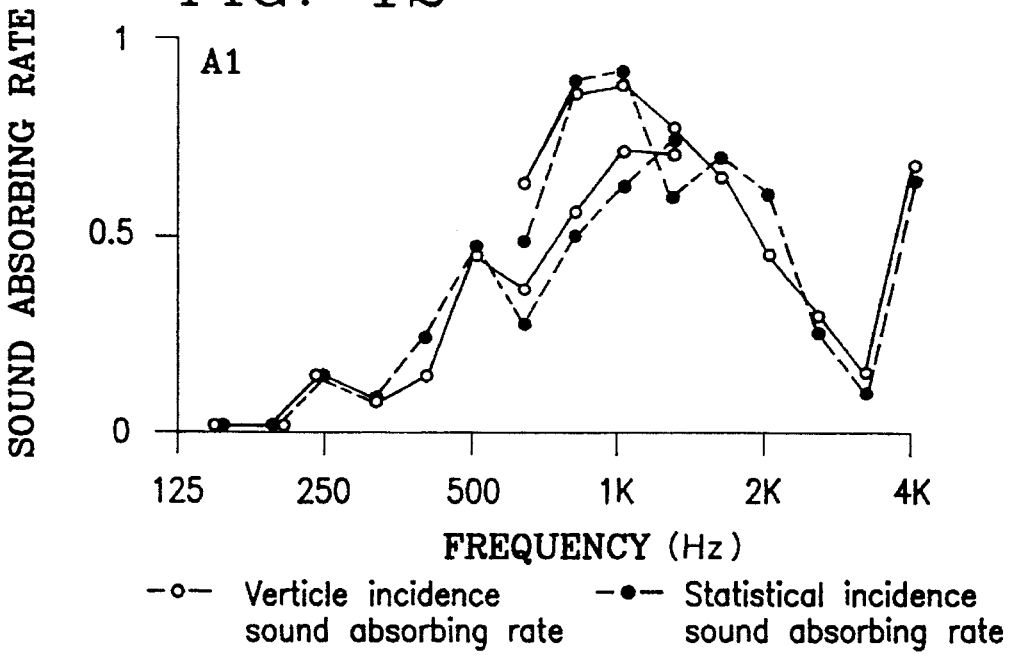
FIG. 13
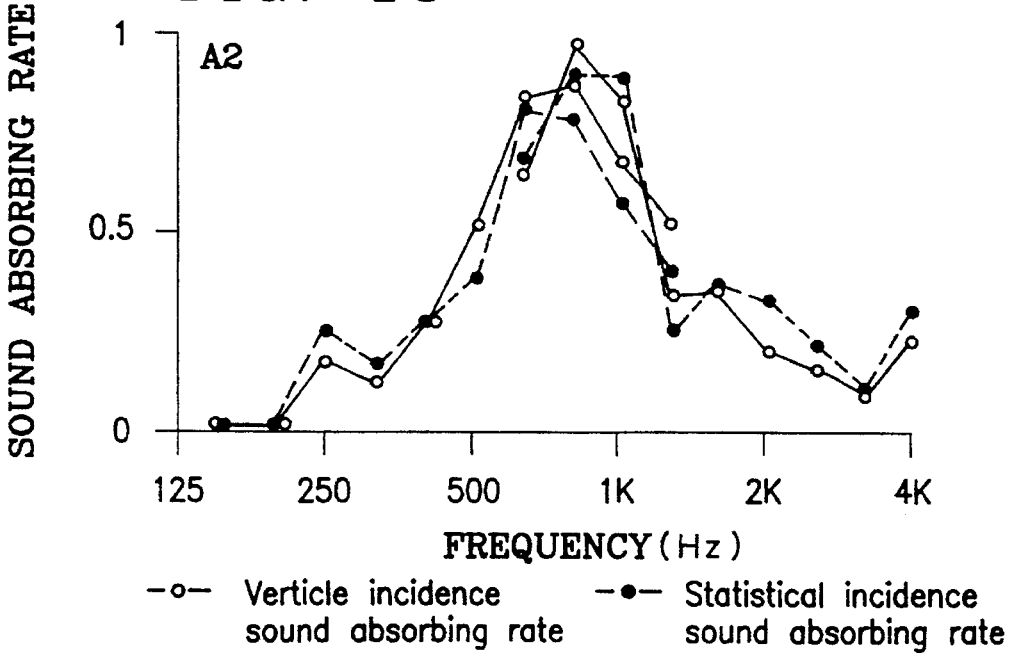

LIGHT TRANSMISSIVE SOUND ABSORBING MEMBER

BACKGROUND OF THE INVENTION

The present invention relates to a sound absorbing member having a light transmissive property.

Conventionally, sound absorbing members such as a plastic foaming member formed in a fiber mat or including communication pores have been often used in the ceiling, walls, and the like for a building. These sound absorbing members are required by no means to have a light transmissive property and thus most of them do not have the light transmissive property.

In recent years, as a ceiling member or a wall member for a certain type of building having a membrane structure or as a composite material with a lighting window used in a factory, there has been demanded a sound absorbing member which has a light transmissive property. However, conventionally, there has not been developed this type of sound absorbing member. Quite lately, a sound absorbing member using a glass fiber mat has been available on the market. However, it has only such a light transmittance of 25% or less that an image cannot be seen through the member.

The sound absorbing property of a sound absorbing material is determined by the following conditions: That is, (1) the flow resistance within the material, (2) the porosity of the material, (3) the thickness of the material, (4) the background conditions, and the like. When a sound wave enters the surface of the material, then it travels through the air in gaps within the material into the interior of the material. At that time, part of the sound energy is converted to heat energy due to the viscous friction of the air to thereby absorb a sound energy. At the same time, sound absorption is also produced due to heat conduction between the air in the slight gaps of the material and the slight gap walls. Therefore, in order to obtain a certain degree of sound absorption, the density of the material must be increased and the diameter of a fiber must be decreased. As a result, even if a transparent glass fiber is used, the light transmissive property of the glass fiber is lost, which results in the low light transmittance.

SUMMARY OF THE INVENTION

The present invention has been made to eliminate the above drawbacks found in the conventional sound absorbing member. Accordingly, it is an object of the invention to provide a sound absorbing member which has not only a sound absorbing property but also a light transmissive property.

After having carefully studied how to obtain both a light transmissive property and a sound absorbing property, the present inventor has found the following facts. That is, a sheet member such as a transparent film, a plate member or the like has an excellent light transmissive property but, if it does not have air permeability, a sound absorbing effect by itself can be little expected. However, if two of such sheet members are spaced apart from each other to provide a space between them and through holes are opened at such positions of the sheet members that the holes are not overlapped to make the sheet members permeable, then the two sheet members are able to have sound absorbing properties. Also, if the space is divided at a proper position thereof by a sound absorbing material and a sound wave is transmitted through the sound absorbing material, then the sound absorbing properties of the two sheet members can be improved further. Further, since the sound absorbing material is not provided on the whole surfaces of the transparent sheet members, the two sheet members are able to have light transmissive properties as a whole. That is, based on the above-mentioned facts, the present invention was developed.

In other words, according to the present invention, there is provided a light transmissive sound absorbing member which comprises a first sheet member having a light transmissive property and including a plurality of through holes, a second sheet member so disposed as to provide a space between the first sheet member and itself, the second sheet member having a light transmissive property and including a plurality of through holes, and partition members interposed between the first and second sheet members to divide the space between them into a plurality of small spaces, wherein each of the partition members includes a sound absorbing material so disposed as to permit the mutually adjoining small spaces to communicate with each other, and most of the plurality of through holes formed in the first sheet member are so disposed as to communicate with other small spaces than the small spaces in communication with the through holes formed in the second sheet member.

BRIEF DESCRIPTION OF THE DRAWINGS

FIG. 7 (*b*) is a schematic section view of still another embodiment of a light transmissive sound absorbing member according to the present invention;

FIG. 11 is a schematic perspective view to show how to mount the test piece to the acoustic pipe;

FIG. 12 is a graphical representation of sound absorbing rates provided by a test piece A1;

FIG. 13 is a graphical representation of sound absorbing rate provided by a test piece A2;

DETAILED DESCRIPTION OF THE INVENTION

Preferred embodiments of the present invention will now be described in more detail with reference to the accompanying drawings.

Figure 1:
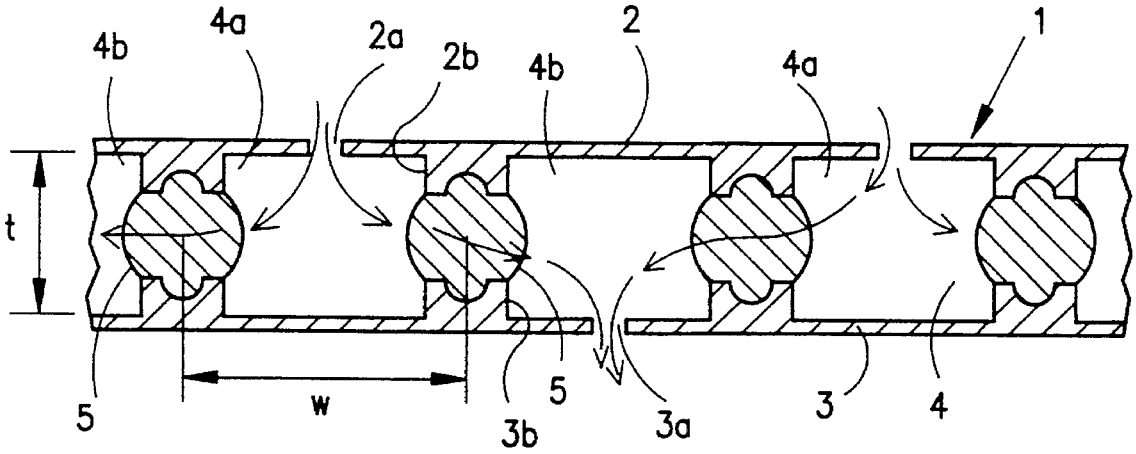
FIG. 1 is a schematic section view of a light transmissive sound absorbing member according to the present invention, illustrating the basic structure thereof.

FIG. 1 is a schematic section view of a basic structure of a light transmissive sound absorbing member 1 according to the present invention. Referring now to the structure of the light transmissive sound absorbing member 1 shown in FIG. 1, first and second sheet members 2 and 3 each having a light transmissive property are disposed in such a manner that a space 4 can be formed between the two sheet members 2 and 3; partition members 5 each formed of sound absorbing material are interposed between the first and second sheet members 2 and 3 to divide the space 4 into a plurality of small spaces 4*a*, 4*b* and the mutually adjoining small spaces 4*a* and 4*b* are made to communicate with each other by their associated partition member 5; and, through holes 2*a*, 3*a* are formed in the first and second sheet members 2 and 3 in such a manner that the through holes 2*a*, 3*a* are respectively in communication with different small spaces 4*a*, 4*b*.

According to the light transmissive sound absorbing member 1 having the above-mentioned structure, when a sound wave enters the first sheet member 2, as shown by arrows in FIG. 1, it travels through the through hole 2*a* formed in the first sheet member 2 into the small space 4*a*, next travels through the partition member 5 formed of sound absorbing material into the adjoining small space 4*b*, and leaves through the through hole 3*a* formed in the second sheet member 3. In this case, a sound absorbing operation is carried out while the sound that enters the light transmissive sound absorbing member 1 travels through the through hole 2*a* into the small space 4*a* and then turns around. Also, the sound is partly absorbed by the partition member 5 while it is passing through the partition member 5. Further, the sound is partly absorbed also while it turns around in the small space 4*b* and leaves through the through hole 3*a*. Thus, the sound can be absorbed well. Also, although the light transmissive property of the member 1 is reduced in the portions thereof where the partition members 5 each formed of sound absorbing material are disposed, the portions thereof where no partition member 5 is disposed have a light transmissive property and, therefore, the light transmissive sound absorbing member 1 is able to have light transmissive property to a considerable extent as a whole.

Figure 2:
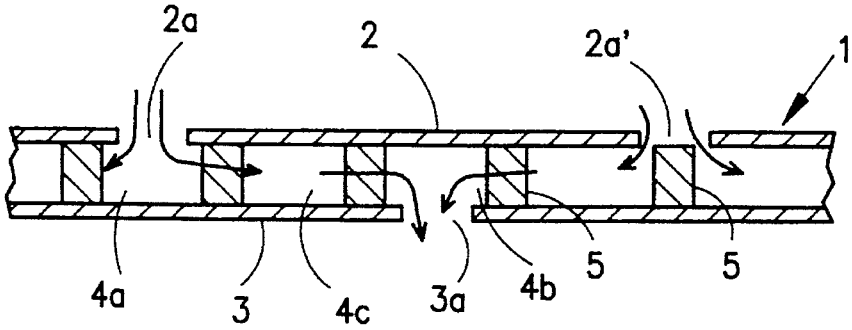
FIG. 2 is a schematic section view of an embodiment of a light transmissive sound absorbing member according to the present invention.

As described above, according to the present invention, a sound wave is guided through a through hole in the first sheet member 2 into a small space, is then guided through a sound absorbing material into another small space, and is then discharged externally through a through hole formed in the second sheet member 3, whereby a sound absorbing effect can be obtained. Therefore, the positions of the through holes 2*a*, 3*a* respectively formed in the first and second sheet members 2 and 3, in principle, are decided in such a manner that they are not opened in the same small space 4*a* or 4*b*. However, even if the two through holes 2*a* and 3*a* are opened in the same small space, if the number of such small spaces is small while a large number of small spaces are formed, the sound absorbing effect of the whole member 1 is reduced a little but the member 1 still has a considerable sound absorbing effect. Therefore, such structure also falls within the scope of the present invention. In other words, according to the present invention, most of the plurality of through holes 2*a* formed in the first sheet member 2 may be disposed such that they communicate with other small spaces than the small spaces in communication with the plurality of through holes 3*a* formed in the second sheet member 3. It is not always necessary that the through holes 2*a* or 3*a* are opened in all of the small spaces that are divided by the partition members 5 each formed of sound absorbing material. As shown in FIG. 2, no problems arise even if there is present a small space 4*c* in which no through hole is opened. Also, there can be formed such a through hole 2*a*' that communicates with two mutually adjoining small spaces. The arrangement, sizes and the like of the through holes will be described later.

Figure 3:
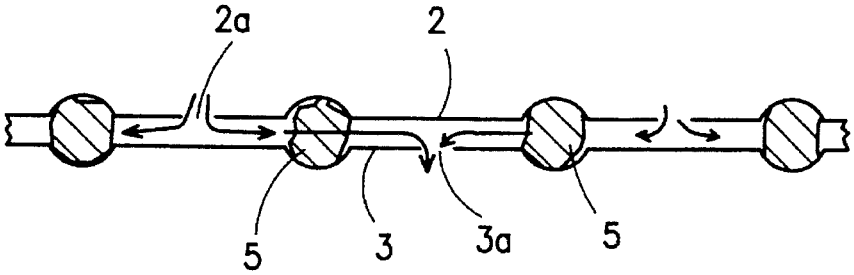
FIG. 3 is a schematic section view of another embodiment of a light transmissive sound absorbing member according to the present invention.

As the first and second sheet members 2 and 3 used in the present invention, there can be used various types of members ranging from a soft film-like member (which is hereinafter referred to as a soft type member) to a hard plate-like member (which is hereinafter referred to as a hard type member), provided that it has a light transmissive property. As the sheet member of a hard type, there are available (A) a transparent plastic sheet formed of polycarbonate, acryl or the like, (B) an FRP semi-transparent plate formed of vinyl chloride/polyester glass fiber or the like, (C) a glass plate, and the like. On the other hand, as the sheet member of a soft type, there can be used a transparent film or a semi-transparent film which is formed of acryl, vinyl chloride or the like. When the sheet member of a soft type is used, as shown in FIG. 3, the distance between the first and second sheet members 2 and 3 at the portions where the partition members 5 serving as a sound absorbing material are located, is different from that at the remaining portions. However, such difference causes no problem at all. Referring to the shape of the sheet member, as shown in FIG. 1, the sheet member may include on the inside thereof projections 2*b*, 3*b* which are used to fix the partition members 5, or, as shown in FIG. 2, it may be flat with no projections. When the flat sheet is used, normally, the partition members 5 are mounted by adhesion and, in this case, the smaller the contact surface thereof, the better the sound absorbing property.

Figure 4:
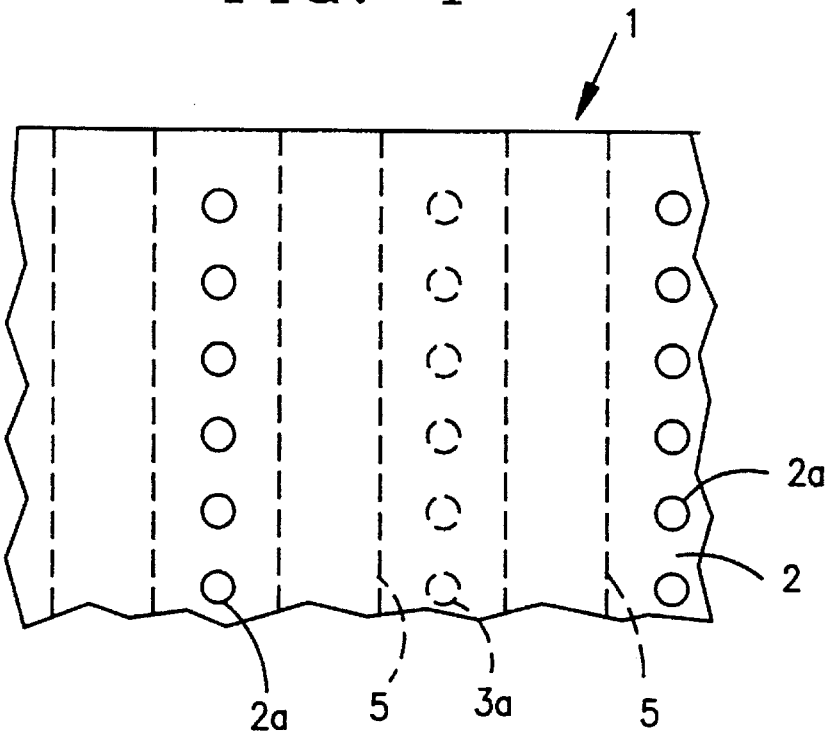
FIG. 4 is a schematic plan view of a pattern of arrangement of partition members used in the present light transmissive sound absorbing member.
Figure 5:
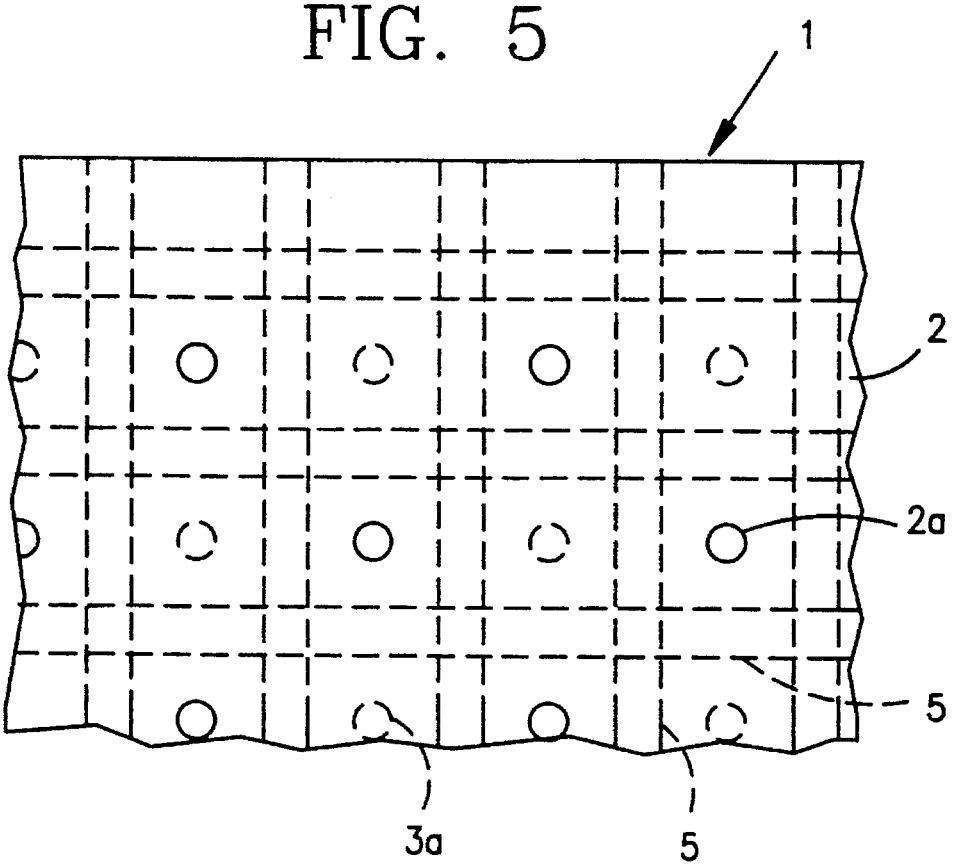
FIG. 5 is a schematic plan view of another pattern of arrangement of the partition members.
Figure 6A:
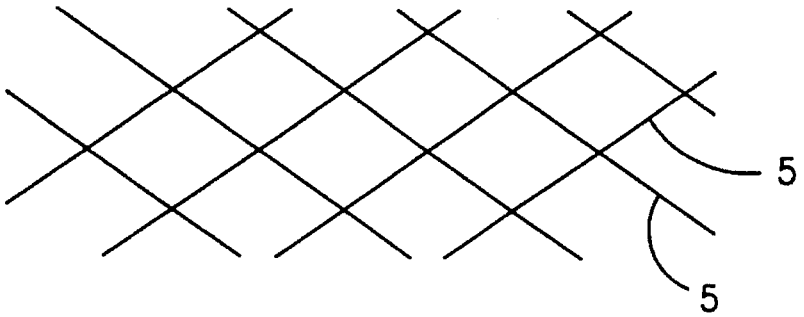
FIGS. 6 (*a*), 6(*b*) and 6(*c*) are respectively plan views of still another patterns of arrangement of the partition members.
Figure 6B:
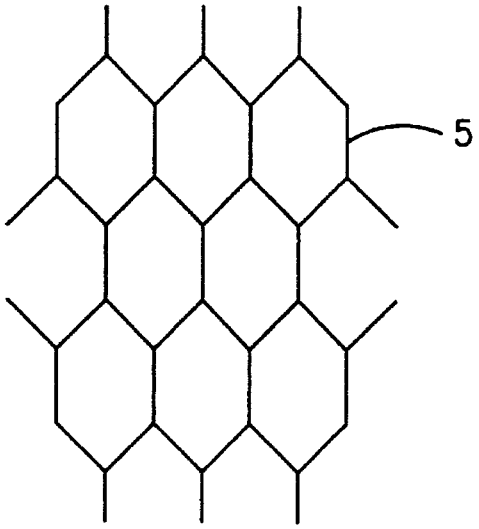
Figure 6C:
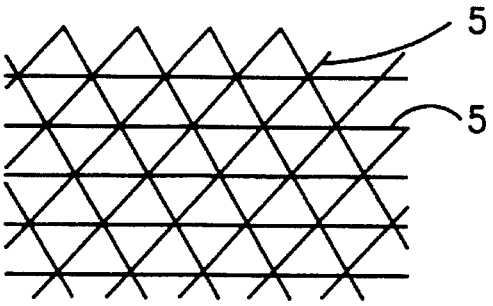

According to the present invention, the partition members 5 can be arranged in various arrangement patterns. For example, the arrangement patterns include a parallel pattern in which a plurality of partition members 5 are arranged in parallel as shown in FIG. 4, a square pattern in which a plurality of partition members 5 are so arranged as to intersect one another at right angles as shown in FIG. 5, a diamond-shaped pattern in which a large number of diamond shapes are formed as shown in FIG. 6(*a*), a hexagonal pattern as shown in FIG. 6(*b*), a triangular pattern as shown in FIG. 6(*c*), and the like.

Figure 7A:
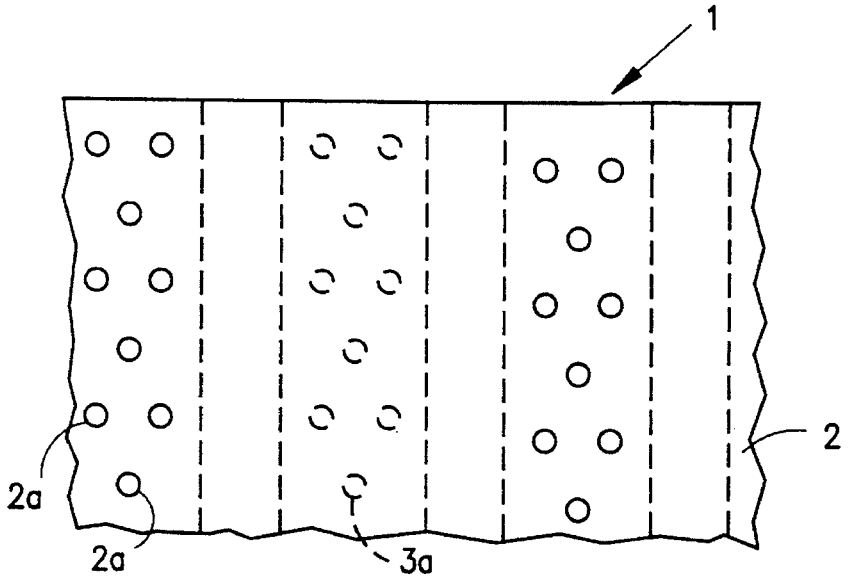
FIG. 7 (*a*) is a schematic plan view of yet another pattern of arrangement of the partition members.
Figure 7B:
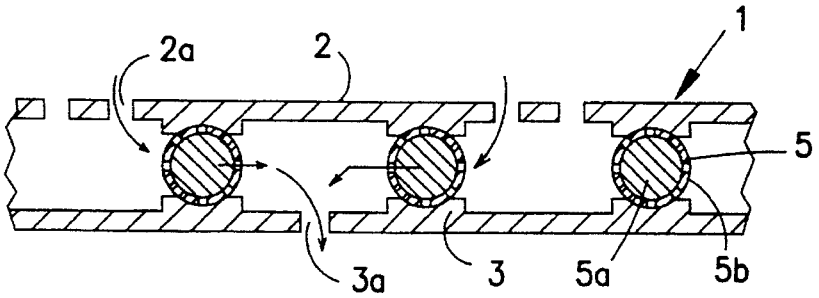

The partition member 5 may be formed of only the sound absorbing material or a combination of a sound absorbing material with another material. In FIGS. 7(*a*) and 7(*b*), there is shown a light transmissive sound absorbing member i using the partition members 5 each of which is formed of a combination of a sound absorbing material with another material. This partition member 5 is structured such that a sound absorbing material 5*a* is filled into a porous pipe 5*b*. The porous pipe 5*b* is a pipe made of plastics or the like having a large number of holes opened in the peripheral surface of the pipe. The porous pipe 5*b* is used not only to hold the sound absorbing material 5*a* but also to reinforce the first and second sheet members 2 and 3. As the sound absorbing material to be used in the partition member 5, there are available fiber materials (which include inorganic fibers such as glass fiber, rock wool and the like, organic fibers such as Vinylon fiber and the like, and metal fibers such as aluminium and the like), plastic foam material (communication pores), sintered metal, and the like. When the fiber material or plastic foam material is used, if the material is soft, it acts so as to fill up a gap against the first and second sheet members 2 and 3 to thereby stabilize the sound absorbing property of the light transmissive sound absorbing member 1, which is favorable for the object of the present invention. Also, when the sound absorbing member formed of the fiber material is used as the partition member 5, threads made of a large number of fibers and having a sound absorbing property may be woven into mesh textiles, and the textiles, as they are, may be used as the partition members 5. If the textiles as they are inserted between the first and second sheet members 2 and 3, then they serve as the partition members 5 that are arranged in a square pattern as shown in FIG. 5.

The size of the small spaces 4*a*, 4*b* to be formed between the first and second sheet members 2 and 3 by the partition member 5 as well as the thickness of the partition member 5 are determined in consideration of the sound absorbing property and light transmittance. In general, it is preferable that the plane dimension of the small space plane (dimension W shown in FIG. 1) may be of the order of 1 to 20 mm and the dimension of the small space in the thickness direction thereof (dimension t shown in FIG. 1) may be of the order of 0.5 to 10 mm. The thickness of the partition member 5 may be preferably determined such that the projection area of the partition member 5 is about 60% or less of the area of the first or second sheet member. If the partition member 5 has such thickness, then the light transmittance of the whole light transmissive sound absorbing member can be of about 40% or more.

The arrangement of the through holes 2*a*, 3*a* formed in the first and second sheet members 2 and 3, as described before, is determined so that the through holes 2*a* and 3*a* are not opened in the same small spaces as much as possible. However, in the respective sheet members, the through holes are preferably distributed throughout them as uniformly as possible. Also, in the arrangement of the through holes, the through holes may be arranged regularly or irregularly. Since the diameters of the through holes 2*a*, 3*a* do not have a great influence on the sound absorbing rate, they may be determined properly within the range of the order of 1 to 10 mm, and preferably, they may be selected in the range of 1 to 5 mm. If the hole opening rate of the member (i.e., the pecentage of the combined area of the through holes 2*a* with respect to the area of the first sheet member 2 or the second sheet member 3) becomes small, then the member shows a film-like property and the resonance frequency moves toward the low frequency side. Therefore, preferably, the hole opening rate may be 20% or so when a sound absorbing effect for intermediate and high sound ranges is expected, and 10% or less when a sound absorbing effect for intermediate and low sound ranges is expected. However, if the hole opening rate is lowered down too much, then the sound absorbing effect is lost and, therefore, the hole opening rate may be preferably 1% or more. Generally, the diameter and hole opening rate of the through hole 2*a* of the first sheet member 2 are determined equal to the diameter and hole opening rate of the through hole 3*a* of the second sheet member 3. However, they can also be changed properly as the need arises.

The light transmissive sound absorbing member that has been described heretofore shows the minimum unit of the sound absorbing member according to the present invention. That is, according to the present invention, on the basis of the minimum unit which comprises a first sheet member, partition members and a second sheet member, as the need arises, another partition members, a third sheet member (having a similar structure to the first sheet member), another partition members, a fourth sheet member (having a similar structure to the second sheet member), . . . can be added. That is, a laminated structure can also be employed.

In the light transmissive sound absorbing member according to the present invention, as shown in FIG. 1, the through holes formed in the first and second sheet members 2 and 3 are shifted in position from each other to produce resistance between them, which limits the portion that permits the sound wave to transmit. In particular, as shown by arrows in FIG. 1, the sound wave is made to travel laterally between the first and second sheet members 2 and 3 and thus the travel distance of the sound wave is far longer than the distance thereof necessary when the sound wave passes straight through them. Also, the sound absorbing material (partition member 5) is disposed along the traveling path thereof. That is, the shifted positions of the through holes and the provision of the sound absorbing material increase resistance within the present light transmissive sound absorbing member and thereby increase the loss of sound energy, so that the present light transmissive sound absorbing member can have a desired sound absorbing property. Also, the sound absorbing materials are not disposed in the entire areas of the first and second sheet members, which permits the present sound absorbing member to have a considerable light transmissive property as a whole.

The light transmissive sound absorbing member according to the present invention can be used suitably as a ceiling member or a wall member for a building of a membrane structure, or as a composite member with a lighting window in a factory. In this case, the light transmissive sound absorbing member can be used singly or a plurality of light transmissive sound absorbing members can be used in a laminated structure in which they are put on one another at suitable distances.

Next, the results of measurement of the sound absorbing property of the light transmissive sound absorbing member according to the present invention, will be described.

Figure 8:
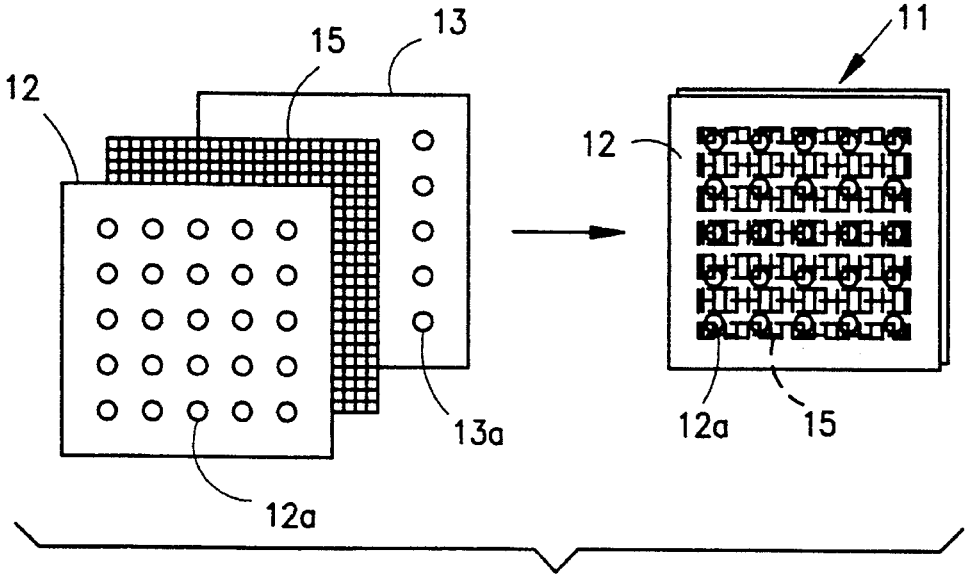
FIG. 8 is a schematic perspective view to show how to produce a test piece used in a sound absorbing test.
Figure 9:
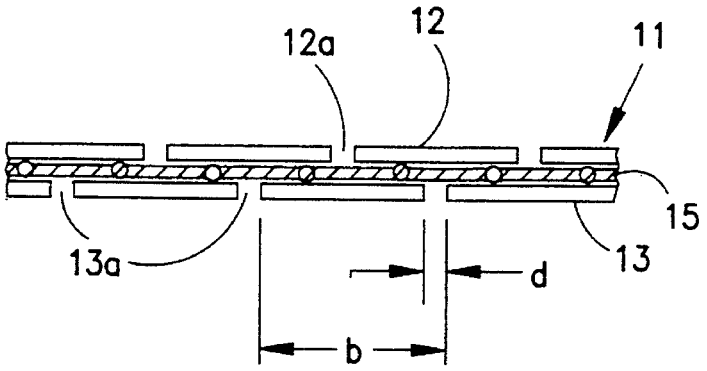
FIG. 9 is a schematic section view of the test piece shown in FIG. 8.

As shown in FIG. 8, a partition member 15 consisting of a mesh-like fiber film was held by first and second sheet members 12 and 13 respectively including a plurality of circular holes 12*a* and 13*a* opened regularly therein, and they were bonded together to form a light transmissive sound absorbing member 11. FIG. 9 shows the section of the light transmissive sound absorbing member 11 exaggeratedly. In FIG. 9, the holes 12*a* and 13*a* are disposed in such a manner that they are not superimposed on each other. Here, as the fiber film and plastic film, there were used those having the following specifications and these films were used in combination to thereby produce 8 kinds of test pieces A1 to A8 of the light transmissive sound absorbing member (the embodiments of the present invention) as shown in Table 1.

(1) Fiber film specifications: The material that was used as the fiber film was a textile obtained by weaving threads of glass fiber into a mesh shape, and there were prepared three kinds of fiber films as follows:

Fiber film 1:

Surface density—0.22 kg/m$^2$ This is a film which is woven at an interval of about 2 mm in a mesh shape and includes a fluorine coating on the surface thereof.

Fiber film 2:

Surface density—0.42 kg/m$^2$ This is a film which is woven at an interval of about 5 mm in a mesh shape and includes a fluorine coating on the surface thereof.

Fiber film 3:

Surface density—0.26 kg/m$^2$ This is a film which is woven at an interval of about 5 mm in a mesh shape (but includes no fluorine coating on the surface thereof).

(2) Plastic film specifications:

There was used one kind of transparent acrylic film which includes an adhesive surface on one side thereof and has a thickness of 0.1 mm and a surface density of 0.1 kg/m$^2$. There were opened in the acrylic film a plurality of regularly arranged circular holes. The diameter d of the circular hole and the distance b between the holes were changed to thereby change the number n of the holes per 1 cm$^2$ and the hole opening rate P. Table 1 shows these numeric values. Here, in Table 1, the hole opening rate P shows the numeric values on one side of the film.

Also, as shown in Table 1, as comparison examples, there were prepared three kinds of test pieces ml, f1, and f2. In particular, ml consists only of the fiber film 1, and f1 consists of two non-adhesive acrylic films superimposed on each other and bonded to each other at points spaced apart by 1 cm from one another, each film having the same thickness as the adhesive film used in the above-mentioned test piece production.

TABLE 1

| Name of test pieces | | Kinds of fiber films | Acrylic film hole specifications | | | |
|---|---|---|---|---|---|---|
| | | | n (/cm$^2$) | d (mm) | P | b (cm) |
| Embodiments | A1 | 1 | 2.25 | 3.3 | 0.190 | 0.67 |
| | A2 | 1 | 1.00 | 3.3 | 0.086 | 1.00 |
| | A3 | 1 | 0.56 | 3.3 | 0.048 | 1.33 |
| | A4 | 2 | 0.95 | 3.3 | 0.081 | 1.03 |
| | A5 | 2 | 0.95 | 2.5 | 0.047 | 1.03 |
| | A6 | 2 | 0.95 | 2.0 | 0.030 | 1.03 |
| | A7 | 3 | 1.91 | 1.5 | 0.034 | 0.72 |
| | A8 | 3 | 0.95 | 1.5 | 0.017 | 1.03 |
| Comparison Examples | ml | This consists only of a fiber film 1. | | | | |
| | f1 | This consists only of acrylic films. | | | | |
| | f2 | This shows the values that were obtained when the test piece f1 was measured in an air layer of 10 cm provided behind the test piece f1. | | | | |

Figure 10A:
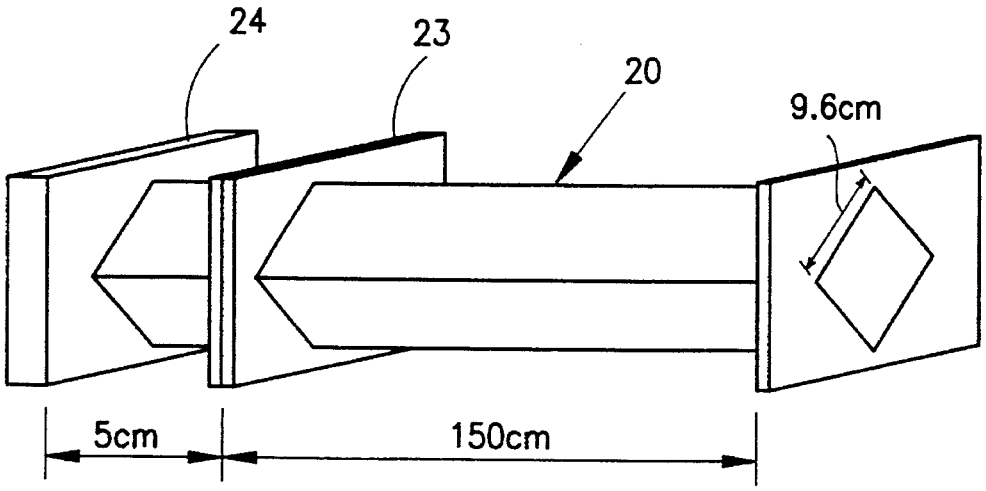
FIGS. 10(*a*) and 10(*b*) are schematic perspective views of two kinds of acoustic pipes respectively used in the sound absorbing test.
Figure 10B:
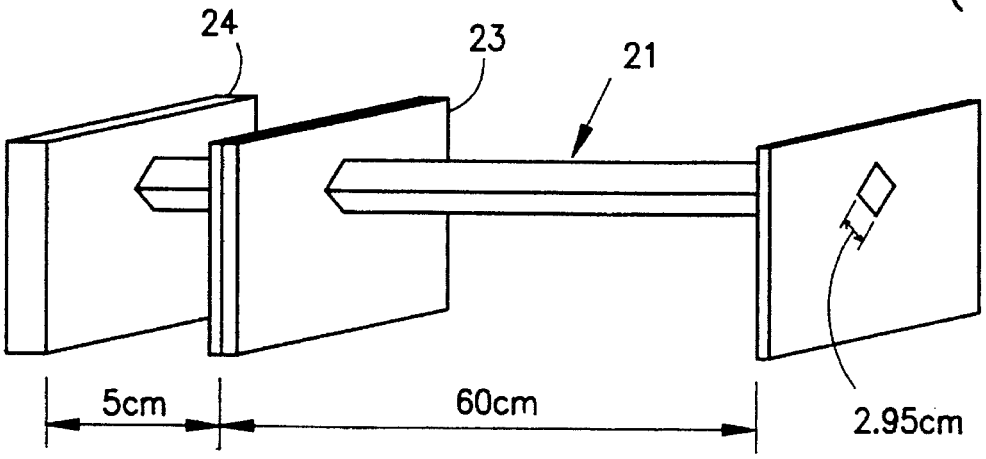
Figure 14:
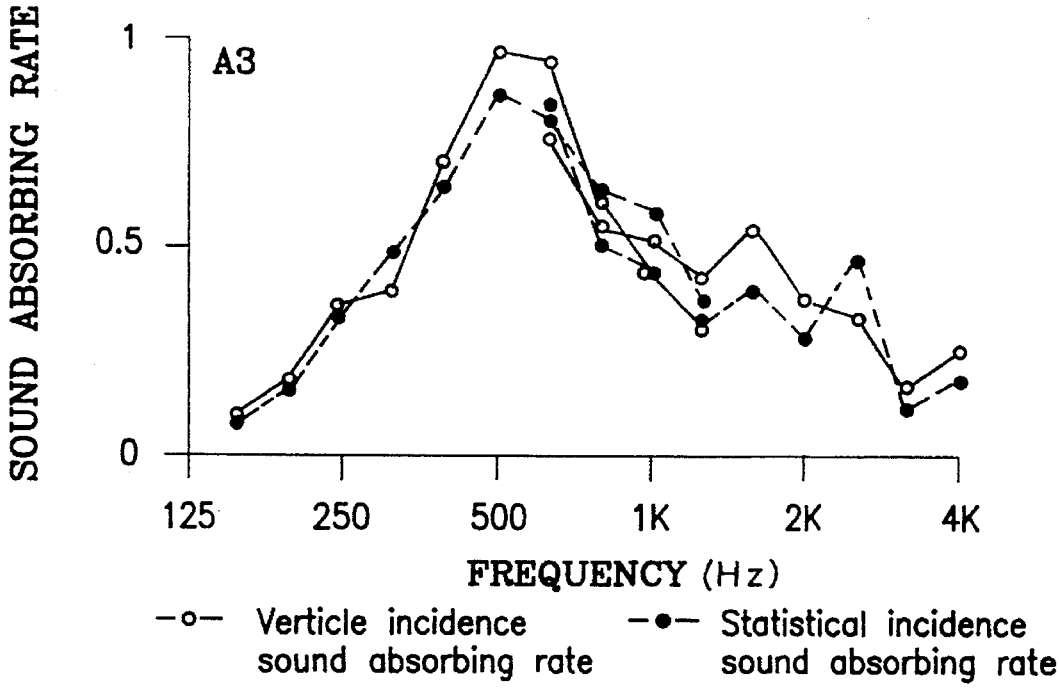
FIG. 14 is a graphical representation of sound absorbing rates provided by a test piece A3.
Figure 15:
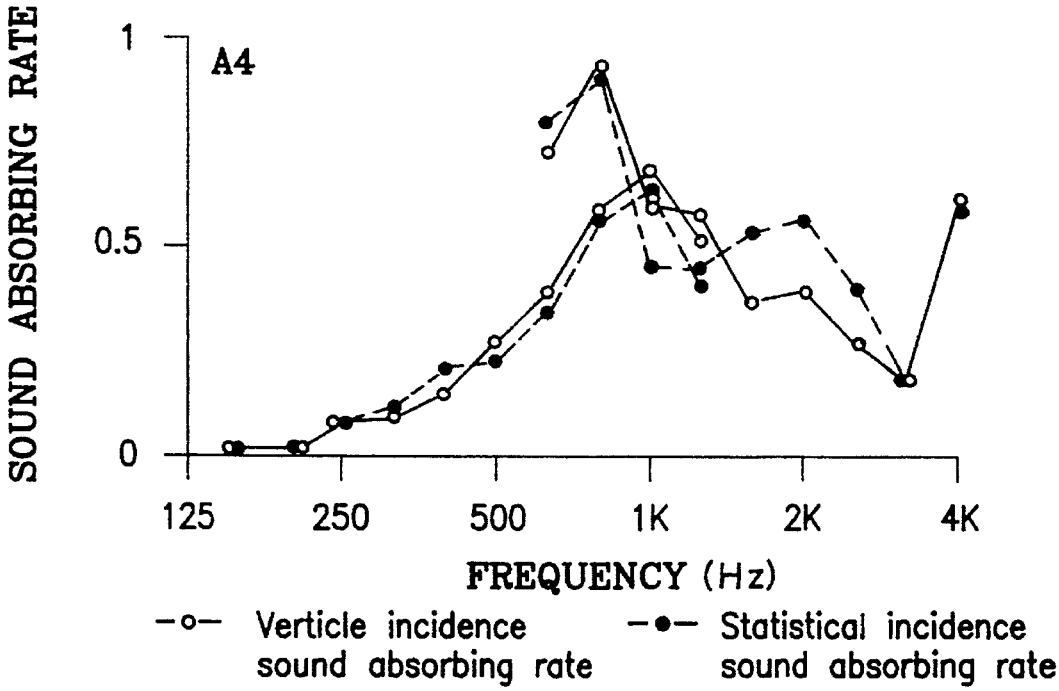
FIG. 15 is a graphical representation of sound absorbing rates provided by a test piece A4.
Figure 16:
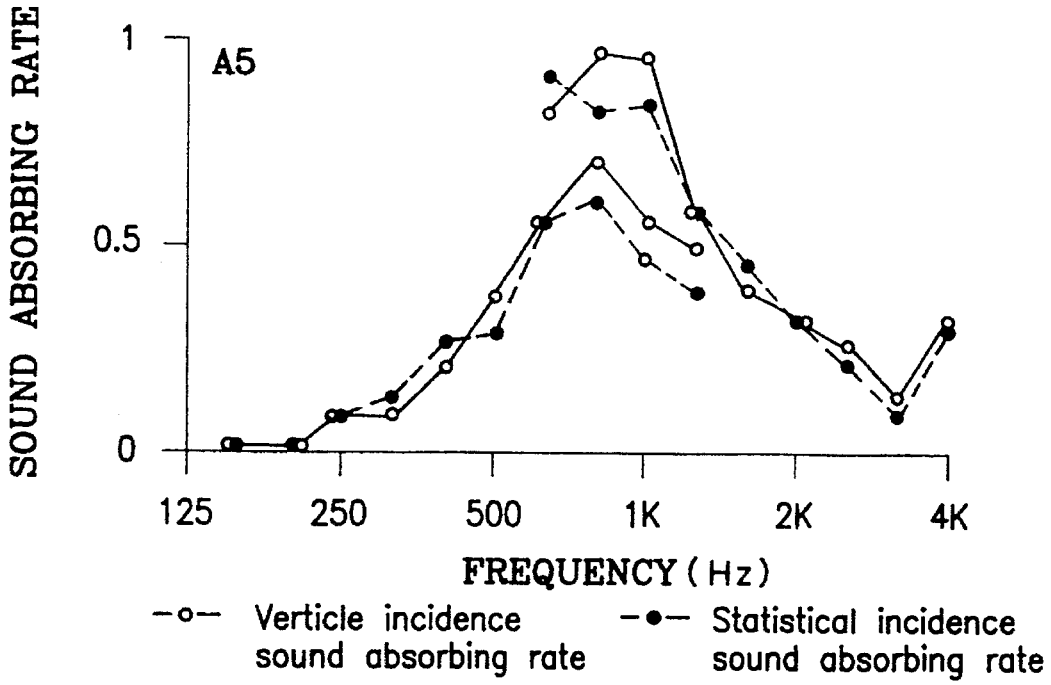
FIG. 16 s a graphical representation of sound absorbing rates provided by a test piece A5.
Figure 17:
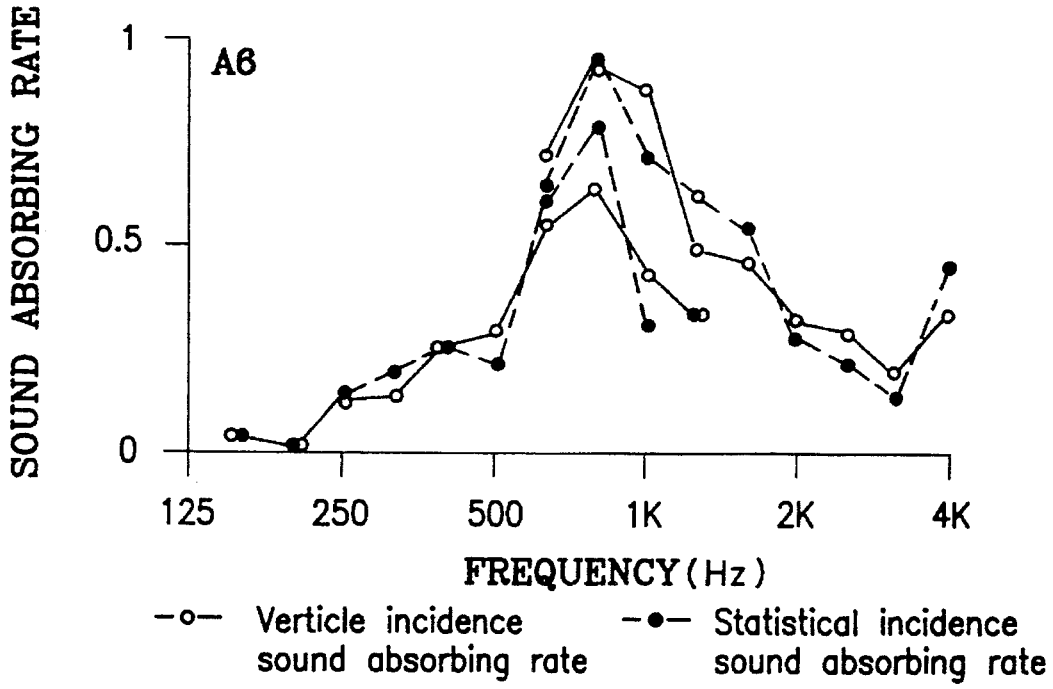
FIG. 17 is a graphical representation of sound absorbing rates provided by a test piece A6.
Figure 18:
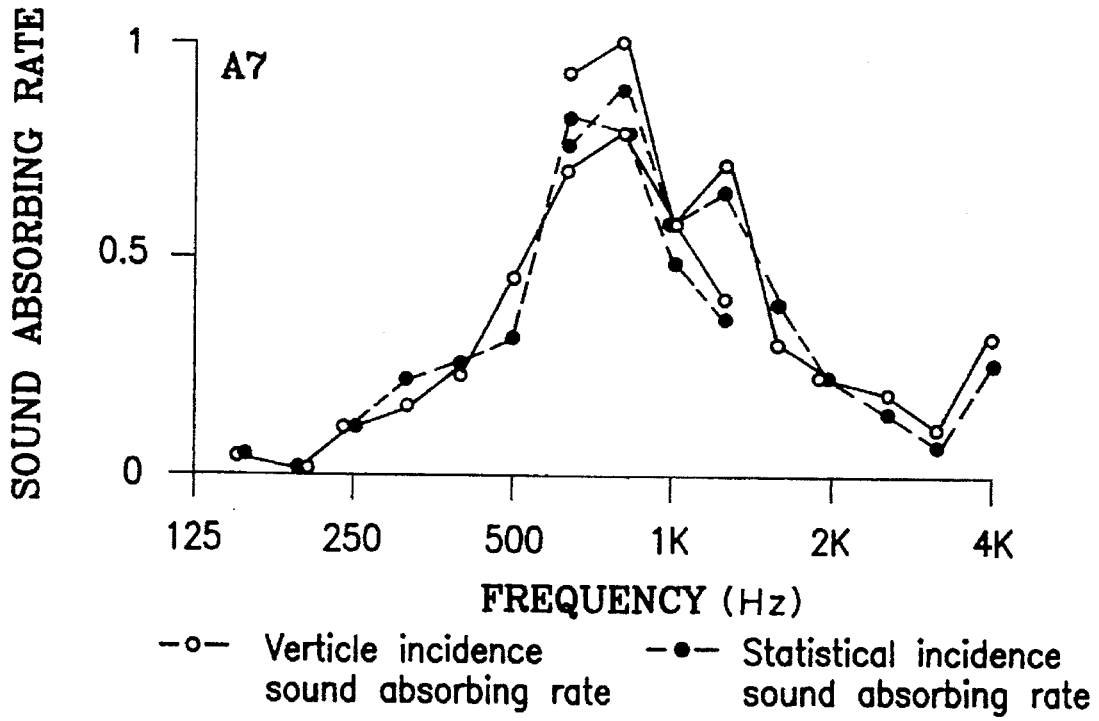
FIG. 18 s a graphical representation of sound absorbing rates provided by a test piece A7.
Figure 19:
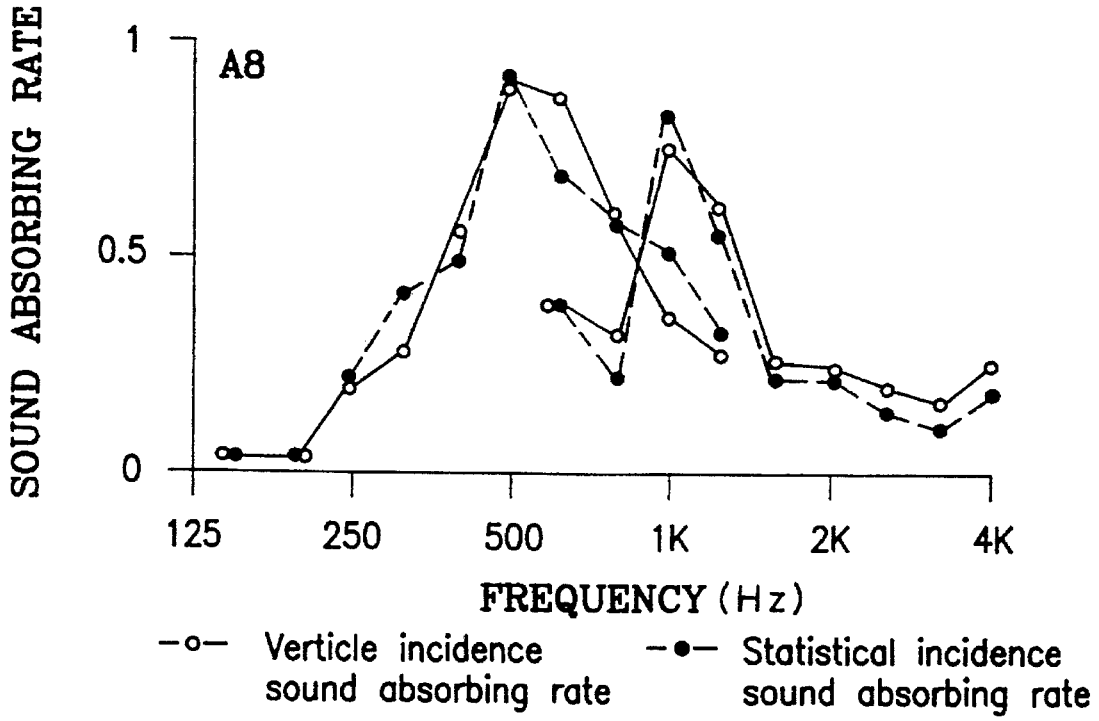
FIG. 19 s a graphical representation of sound absorbing rates provided by a test piece A8.
Figure 20:
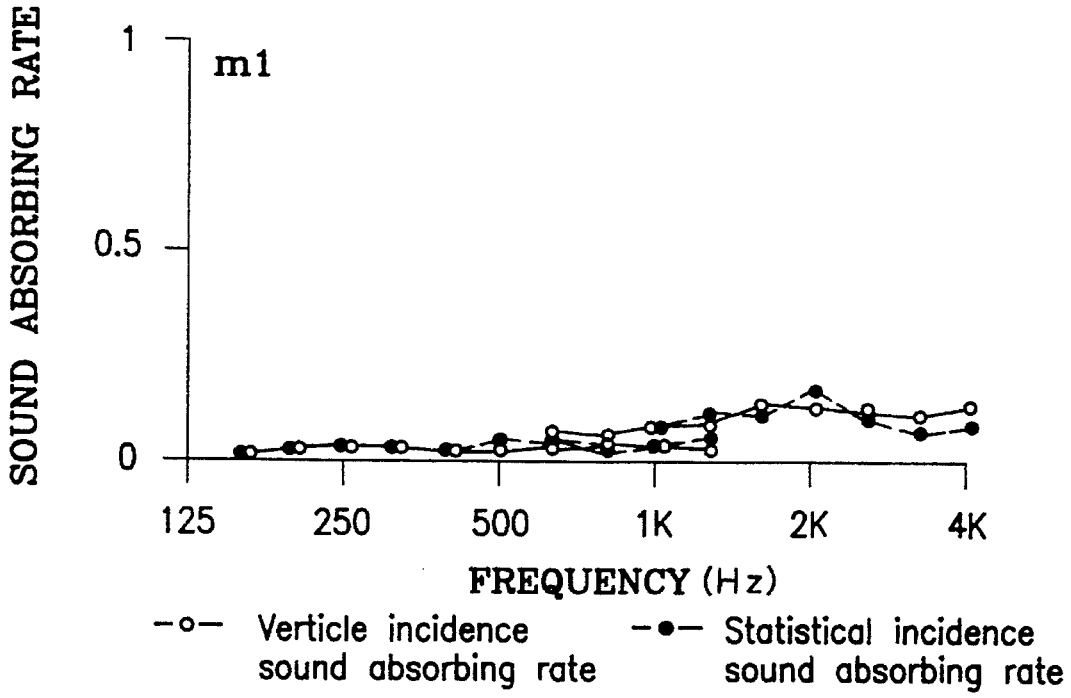
FIG. 20 s a graphical representation of sound absorbing rates provided by a test piece ml.
Figure 21:
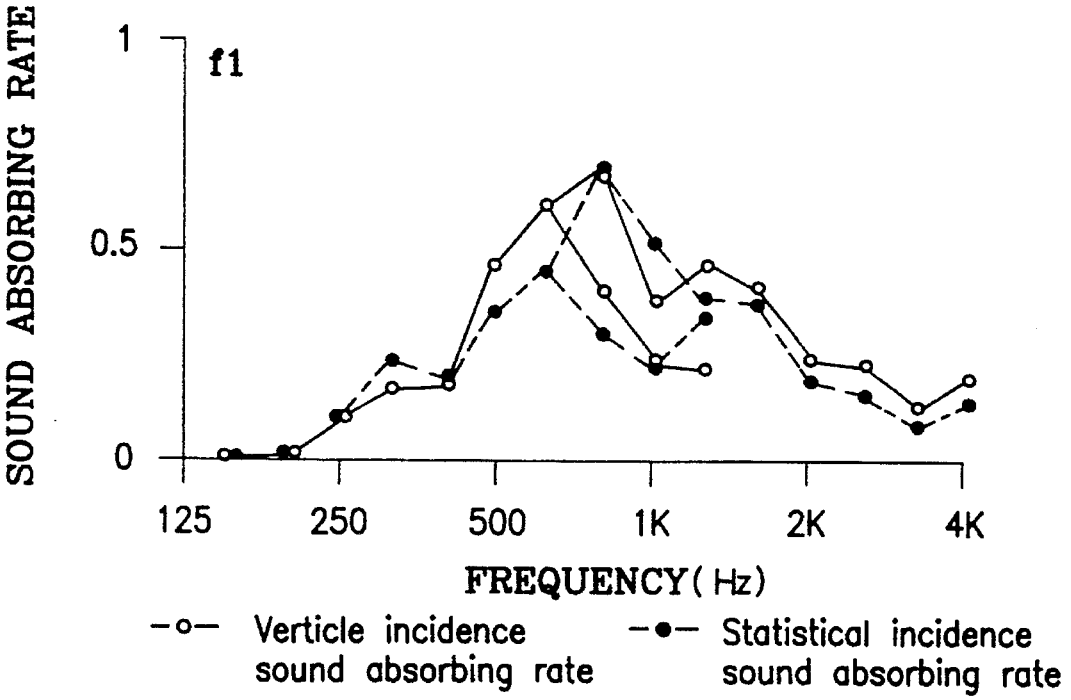
FIG. 21 s a graphical representation of sound absorbing rates provided by a test piece f1; and, FIG. 22 is a graphical representation of sound absorbing rates provided by a test piece f2.
Figure 22:
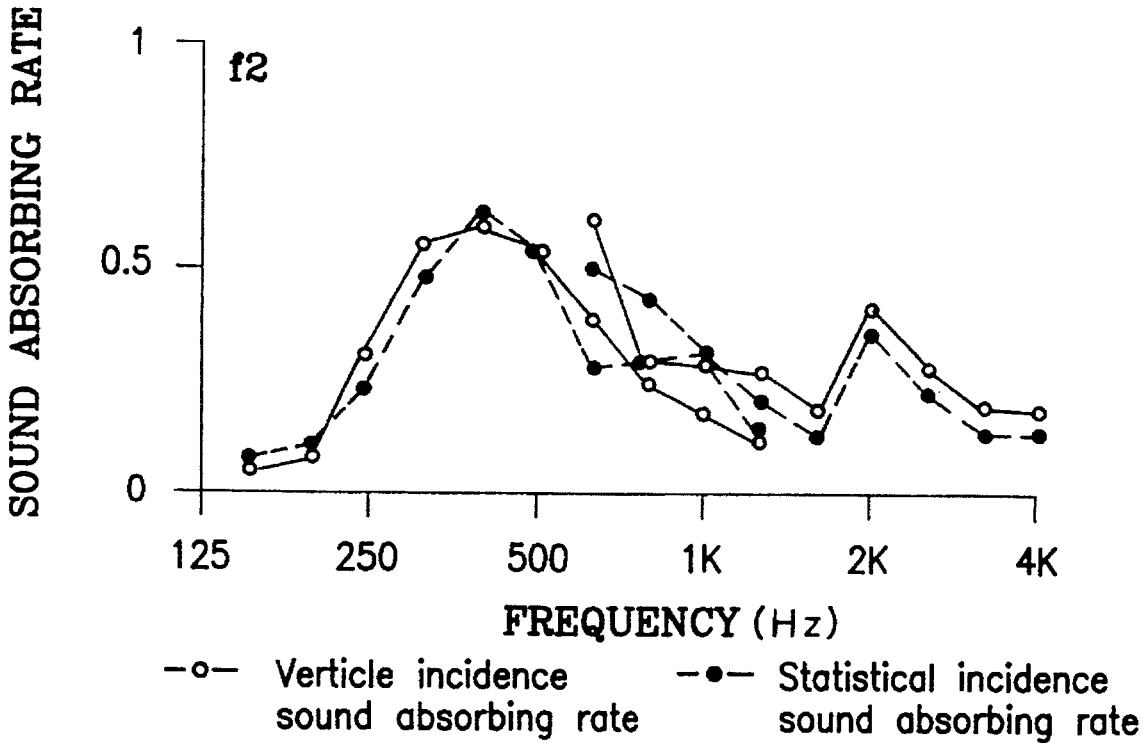

The test pieces shown in Table 1 were used in two kinds of acoustic pipes, one 20 including a thick pipe as shown in FIG. 10(*a*) and the other 21 including a thin pipe as shown in FIG. 10(*b*). The vertical incidence sound absorbing rates of the two acoustic pipes 20 and 21 were measured according to a standing wave method. Also, using the values of the normal acoustic impedance at that time, the statistical incidence sound absorbing rates of the acoustic pipes 20 and 21 were calculated. To mount the test piece to the acoustic pipe, the test piece was held by the connecting flanges 23 of the acoustic pipe, a rigid wall 24 was disposed behind them, and an air layer of 5 cm was interposed between the rigid wall 24 and test piece. When fixing the test piece to the acoustic pipe, as shown in FIG. 11, in order to prevent sound leakage, several both-side adhesive tapes put on one another were bonded to the periphery of the surface of the test piece 11. Also, the test piece was mounted in such a manner that it was not tensed.

The sound absorbing rates of the respective test pieces obtained by the measurements are respectively shown in FIGS. 12 to 22. In the frequency ranges that are overlapping between the measurements by use of the acoustic pipe 20 (thick pipe) and the measurements by use of the acoustic pipe 21 (thin pipe), some of the measured values were greatly different from each other and, therefore, the values are not averaged but are shown individually.

FIGS. 12 to 22 show the following facts:

A. All of the test pieces according to the embodiments of the present invention show a high sound absorbing rate (having a value of 90% or so as the peak value), and have a very excellent sound absorbing property.

B. If the hole opening rates of the test pieces are reduced, then the test pieces show a filmy property and the resonance frequencies thereof move toward the low frequency side. (A1→A2→A3→A7→A8)

C. If the center distances of the holes are equal, then the sound absorbing property varies little (A5 to A7) when the hole opening rate is in the range of 3 to 10%.

D. Hole diameter has no great influences.

E. Therefore, the hole opening rate of the light transmissive sound absorbing member is preferably about 20% for the intermediate and high sound ranges and 10% or less for the intermediate and low sound ranges. Also, the hole diameter is preferably in the range of 1 to 5 mm.

As has been described heretofore, the light transmissive sound absorbing member of the present invention has not only a high sound absorbing property but also a high light transmissive property and thus it can be suitably used as a sound absorbing member in such a member as requires a light transmissive property, such as a ceiling member or a wall member for use in a building of a membrane structure, or a composite material with a lighting window in a factory.

What is claimed is:

1. A light transmissive sound absorbing member, comprising:

a first sheet member having a light transmissive property and including a plurality of through holes;

a second sheet member so disposed as to form a space between said first sheet member and said second sheet member, said second sheet member having a light transmissive property and including a plurality of through holes; and partition members interposed between said first and second sheet members to divide said space into a plurality of mutually adjoining small spaces, some of said small spaces being in communication with the through holes of the first sheet member and other of said small places being in communication with the through holes of the second sheet member; and wherein each of said partition members includes a sound absorbing material of a type which enables the mutually adjoining small spaces to communicate with each other.

2. A light transmissive sound absorbing member as claimed in claim 1, wherein said first and second sheet members are provided with projections for fixing said sheet members to said partition members.

3. A light transmissive sound absorbing member as claimed in claim 1, wherein each of said partition members includes a porous pipe containing said sound absorbing material.

4. A light transmissive sound absorbing member as claimed in claim 1, wherein a projected area of said partition members onto said first sheet member or said second sheet member is about 60% or less of an area of said first sheet member or said second sheet member.

5. A light transmissive sound absorbing member as claimed in claim 1, wherein a combined area of said through holes is within a range of 1% to 20% of an area of said first sheet member or said second sheet member.

* * * * *